US005119058A

United States Patent [19]

Baldi et al.

[11] Patent Number: 5,119,058

[45] Date of Patent: Jun. 2, 1992

[54] LAMINATED CONDUCTOR FOR HIGH CURRENT COILS

[75] Inventors: Robert W. Baldi; Thomas E. Johnson, both of San Diego, Calif.

[73] Assignee: General Dynamics Corporation, Space Systems Division, San Diego, Calif.

[21] Appl. No.: 715,266

[22] Filed: Jun. 14, 1991

Related U.S. Application Data

[62] Division of Ser. No. 437,702, Nov. 15, 1989, Pat. No. 5,050,293.

[51] Int. Cl.[5] ..... H01F 27/08; H01F 27/28

[52] U.S. Cl. ..... 336/62; 336/96; 336/206; 336/223; 336/228

[58] Field of Search ..... 336/55, 62, 96, 206, 336/223, 228, 225, 61

[56] References Cited

U.S. PATENT DOCUMENTS 1,394,044 10/1921 Stephens ..... 336/62

4,906,960 3/1990 Alexander ..... 336/62

*Primary Examiner*—Thomas J. Kozma

*Attorney, Agent, or Firm*—John R. Duncan; Frank D. Gilliam

[57] ABSTRACT

Method for fabricating a laminated coil conductor for a high current coil which includes wrapping a layer of insulation around a rotatable shaped mandrel and then winding a plurality of copper sheets over the insulation as the mandrel is rotated. Solder is interposed between the copper sheets and between coolant tubes positioned on each end of each coil conductor. The assemblage is then removed from the mandrel and raised to a temperature to bond the copper sheets and coolant tubes together. The assemblage is then placed in a structural box and a plastic is injected into the box to fill any voids between the coil conductor and the box.

An assembly of a plurality of coil conductors arranged in a high current coil according to the method is illustrated.

4 Claims, 1 Drawing Sheet

LAMINATED CONDUCTOR FOR HIGH CURRENT COILS

This is a divisional of co-pending application Ser. No. 07/437,702 now U.S. Pat. No. 5,050,293 filed on Nov. 15, 1989.

BACKGROUND OF THE INVENTION

1. Field of the Invention

This invention relates to improvements in high current coils and more particularly, but not by way of limitation, to a method and arrangement for expeditiously fabricating laminated coil conductors and a coil assemblage adapted to a carry a high electrical current.

2. Description of the Prior Art

In the past the generally accepted method of manufacturing very large coils for high current application involved rolling copper plates to various desired curvatures and then welding such curvatures into the desired ultimate shape, which shape is often a generally "D" shaped configuration. Obviously, such a method was expensive and time consuming to perform and did not yield a coil construction that was entirely satisfactory. Thus, a need has long existed in the prior art for a cost efficient highly producible method of expeditiously fabricating a high quality coil that was capable of carrying a high current. It is believed that the present invention satisfies that long felt need.

The following patents, while of interest in the general field to which the invention pertains, do not disclose the particular aspects of the invention that are of significant interest.

W. Kafka U.S. Pat. No. 3,501,727 issued Mar. 17, 1970 for Liquid-Cooled Electromagnets shows a plurality of overlapping copper coils. During fabrication of the electromagnet a plurality of plastic strips separate the coils with the strips being removed after the coils have been embedded in a castable resin to provide cooling passages therebetween.

Leonard O. Larsen U.S. Pat. No. 1,888,275 issued Nov. 22, 1932 discloses a moisture impervious electrical coil and a method of manufacturing such a coil. Larsen discloses applying to a core alternate layers of windings of wire and an insulating material composed of a fibrous material impregnated with a cellulous derivative. Spool heads also composed of a cellulose impregnated fibrous material are forced into engagement with the layers of interleaving material after the ends of the coil have been dipped in a bath of cellulose acetate dissolved in acetone to cause the heads to coalesce to each later layer and proved a moisture impervious envelope for each layer of winding.

James G. Ford U.S. Pat. No. 2,579,560 issued Dec. 25, 1951 for a Bonded Magnetic Core Structure shows a wound core being made by winding together on a mandrel two strips of electrical sheet steel. When the strips are wound together into a core structure, the edges of alternate laminations of the core will extend beyond or overhang the other laminations on both sides. A suitable bonding agent is used to penetrate between the laminations or turns of the core and to bond the overhanging edges of the laminations to one another and to the narrower laminations to form a unitary core structure.

U.S. Pat. No. 2,882,587 issued on Apr. 21, 1959 to Robert Unger et al relates to brazing methods for producing a unified laminated copper structure particularly adapted for use in the electron tube of the traveling wave type. Unger teaches the alignment of a set of differently configured silver plated copper stampings on an arbor and then placing the aligned stampings on a frame where they are subjected to a high pressure for brazing together.

U.S. Pat. No. 3,269,004 issued on Aug. 30, 1966 to G. A. Smith, Jr. et al is directed to a process of roll bonding stainless steel and aluminum. This patent teaches the roll bonding of dissimilar metals, such as aluminum and stainless steel, for the manufacture of cookware. The strips of the dissimilar metals are subjected to a particular elevated temperature before being roll bonded at a predetermined pressure to accomplish the bonding.

J. M. Campbell U.S. Pat. No. 2,782,497 issued Feb. 26, 1957 for a method of making clad steel. The method uses a base strip of carbon steel and cladding metal strips of stainless steel. The stainless steel strips are electroplated with a metal that may be easily pressure welded to the base strip under heat and pressure.

Harry W. Bundy U.S. Pat. No. 1,892,607 issued Dec. 27, 1932 relates to a method of making a tube which consists in electroplating a layer of copper on both sides of a steel strip and then, after the strip has been formed into a tube, passing the tube through a heating zone at a substantially uniform rate and in a nonoxidizing environment to alloy the copper with the steel and weld the seams of the tube.

J. J. Vienneau U.S Pat. No. 2,689,396 issued Sept. 21, 1954 relates to a method of making magnetic cores. Vienneau discloses winding two long strips of high reduction cold rolled silicon steel about a mandrel. After the strips of steel have been annealed on the mandrel, they are separated to provide separate delta yoke members for three phase cores for stationary electrical induction apparatus.

While certain aspects of the above disclosed prior art are of interest, they do not teach the particular method of manufacturing a laminated conductor for a high current coil or the resultant assemblage.

SUMMARY OF THE INVENTION

In accordance with the present invention, there is provided a method for fabricating a coil conductor for high current coils which includes providing a rotatable mandrel provided with a forming face having a predetermined shape, such as a generally "D" shaped configuration. An inner layer of insulation is wrapped completely around the forming face and then the mandrel is rotated to wind a layer of sheet copper around the forming face of the mandrel. Means are provided to permit bonding together of adjacent turns of the sheet copper. An outer layer of insulation is wrapped completely around the wound turns of copper sheet to provide a wound conductor and then the conductor is raised to a temperature sufficient to bond the adjacent layers of copper sheet together in a unitary structure. Preferably, coolant tubes provided with a bonding medium are positioned against the coil conductor prior to the bonding step.

After the bonding step has been completed, the assemblage is placed in a suitable structural case and any voids which may exist between the assemblage and the structural case are eliminated by injecting a suitable plastic into the case. Any desired number of coil conductors may be provided for the assemblage in this manner.

Other features and attendant advantages of the present invention will become apparent to those skilled in the art from a reading of the following detailed description constructed in accordance with the accompanying drawings and wherein:

DESCRIPTION OF THE PREFERRED EMBODIMENT

Figure 1:
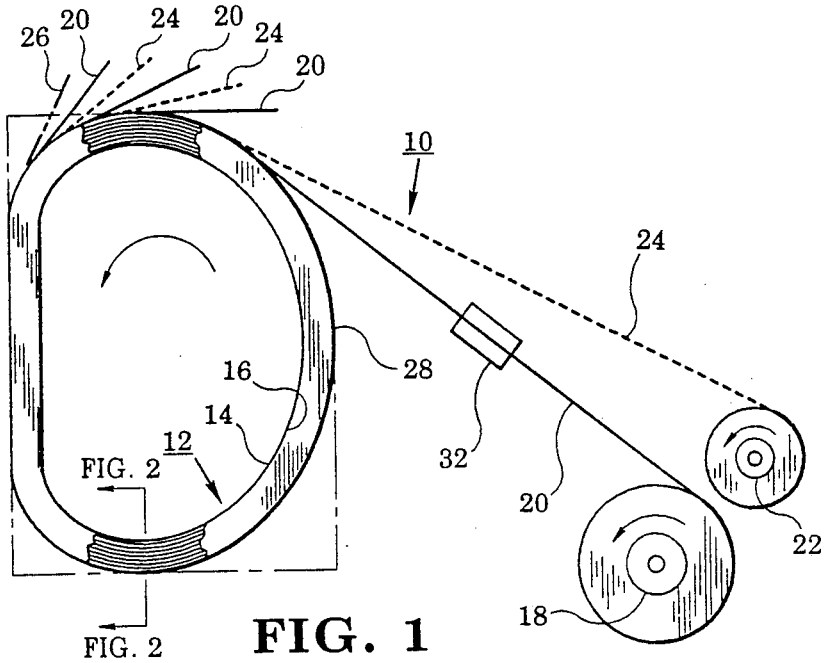
FIG. 1 is simplified schematic shown partially in section of an arrangement adapted to practice certain aspects of the present invention for manufacturing a laminated conductor for a high current coil.

Referring to the drawings in detail and in particular to FIG. 1, the reference character 10 generally designates a laminated coil that is fabricated in accordance with the present invention. A rotatable mandrel 12 that is provided with a suitable forming face 14 having a predetermined shape, such as the illustrated "D" shaped configuration, has an inner layer of a suitable insulation 16 wrapped about the forming face 14. A rotatable supply spool 18 is provided with a roll of sheet copper 20 having a predetermined width. Similarly, a rotatable supply roll 22 is provided with a roll of solder foil 24. As the mandrel 12 is rotated the sheet of copper 20 and the solder foil 24 are wound around the mandrel 12 a predetermined number of turns. Alternatively, instead of providing one supply spool of sheet copper 20 and one supply spool of solder foil 24, it would be within the scope of the present invention to provide additional spools of sheet copper and solder foil, as is shown diagrammatically in FIG. 1.

After the desired number of turns of sheet copper 20 and solder foil 24 have been wound about the mandrel 12, an outer layer 26 of insulation is wound around the outer turn of the conductor. Both the inner layer 16 and the outer layer 26 of insulation are made of a material such as G-11CR fiberglass/epoxy or Kapton which can easily withstand the solder bonding temperature without damage.

Figure 2:
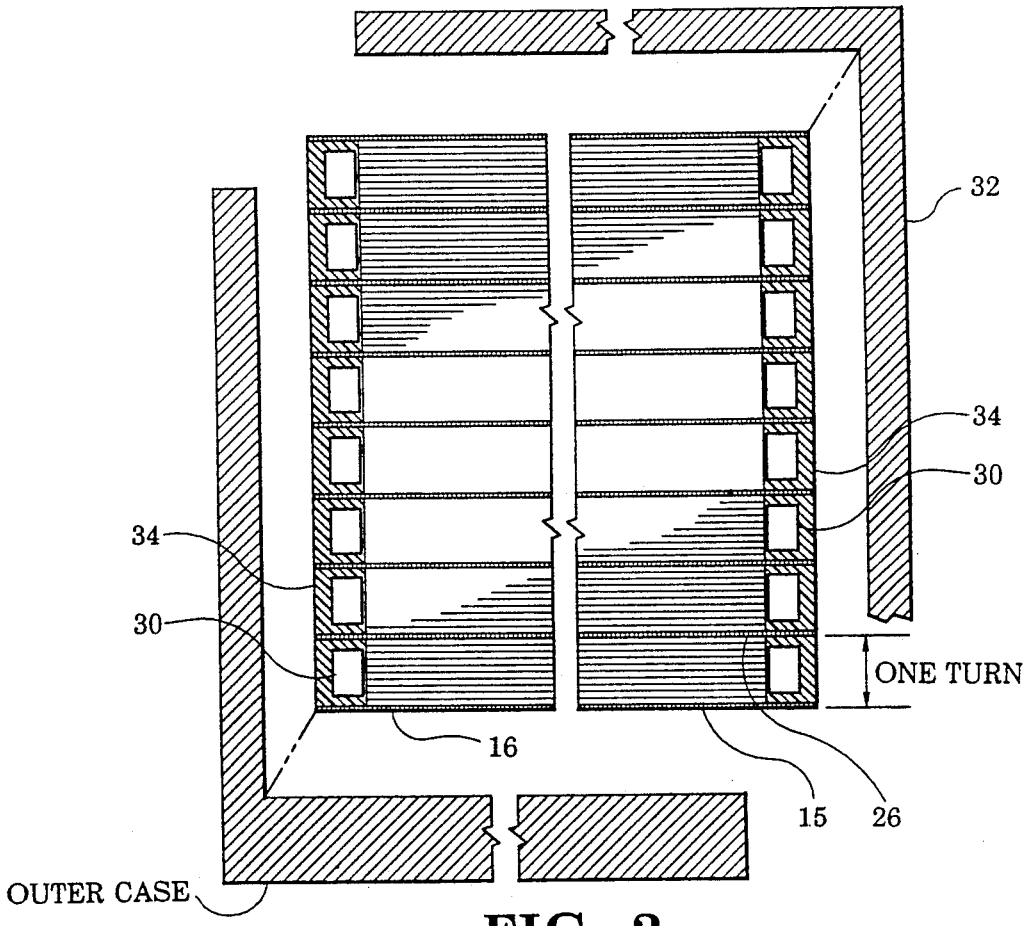
FIG. 2 is a simplified sectional view taken along lines 2—2 in FIG. 1 and showing further aspects of the instant invention.

Referring now to FIG. 2, other aspects of the present invention are illustrated. A suitable coolant tube 30 having a suitable amount of solder foil 24 interposed between it and the coil conductor 28 is positioned at each end of the conductor 28 an is held thereagainst in any suitable manner. As seen most clearly in FIG. 2, the inner and outer layers of insulation extend beyond the outer edges of the coil conductor 28 to overlap the coolant tubes 30 for a purpose which will be set forth hereinafter. The mandrel 12 with the wound conductor 28 is then placed in a suitable oven or the like and raised to a predetermined temperature for a predetermined period of time to cause the solder foil 24 to melt and bond the turns of sheet copper and the coolant tubes together in one unitary structure. The bonded conductor 28 is then allowed to cool for further processing according to the present invention.

While the particular means to bond the sheets of copper 20 and the coolant tubes 30 together into a unitary structure has been illustrated as being solder foil 24, other methods of bonding the unitary structure together are also within the scope of this invention. For example, the sheet of copper 20 could be pretinned with solder as could the coolant tube 30 prior to bonding. In this instance, the cleaning station 32 that is used to clean the sheet copper 20 immediately prior to winding to eliminate oxidation and other contaminants could be dispensed with.

As seen in FIG. 2, while the fabrication of one coil conductor or layer 28 was described in detail the invention contemplates a plurality of turns with insulation interposed therebetween at predetermined intervals may be placed on the mandrel 12 prior to the bonding step. As illustrated, sheet copper 20 could be wound around the mandrel ten turns per coil conductor 28 and a total number of eight coil conductors 28 be provided for the high current coil.

The mandrel 12 is then removed and the assemblage is then placed in a suitable structural case 32 which is welded together to encompass the assemblage. After the outer case 32 has been assembled a suitable thermoplastic such as urethane is injected into the case 32 to displace any voids which ma exist between the coil 28 and the case 32. It will be seen that the outer ends of the insulation 16 and the insulation 26 will contact the inner walls of the case 32 and permit the plastic 34 to fill the void between the coolant tube 30 which is precluded from contacting the outer case 32 by the plastic 34.

It will be appreciated that high current conductors with large width and thickness can be readily fabricated by means of the present invention. The tight winding packs provided by this novel method ensure a conductor having structural integrity to react Lorentz electromagnetic forces. While a coil of ""D" configuration has been illustrated, clearly coils of other shapes could be readily wound. For efficient cooling of the laminated conductor, large volume coolant flow tubes (either circular or rectangular) were shown as being bonded to the edges of the conductor.

It is also to be understood that the illustration has been simplified and various electrical and mechanical connections have been eliminated for ease of understanding.

Although the present invention has been shown and described with reference to a particular embodiment, nevertheless, various changes and modifications obvious to one skilled in the art to which the invention pertains are deemed within the purview of the invention.

What is claimed is:

1. A laminated coil for high current conductor coils which comprises:

a plurality of copper sheets that have been formed to a predetermined shape and bonded together to form at least one laminated coil turn;

a layer of insulation provided on the inner and outer surface of each coil turn;

a coolant tube bonded to each end of each laminated coil turn;

a structural case which surrounds each laminated coil turn; and, a plastic interposed between each coil turn and the structural case to fill any voids therebetween.

2. A laminated coil as defined in claim 1 where the coil includes a plurality of coil turns.

3. A laminated coil as defined in claim 2 wherein the layers of insulation extend beyond the ends of each coil turn so as to space each coil turn from the structural case.

4. A laminated coil as defined in claim 3 wherein the coil turns are formed in a generally "D" shaped configuration.

* * * * *